US006467108B1

(12) United States Patent
Wang

(10) Patent No.: US 6,467,108 B1
(45) Date of Patent: Oct. 22, 2002

(54) STRUCTURE OF CORNER MEMBERS FOR A PLAYPEN

(76) Inventor: Kun Wang, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/915,238

(22) Filed: Jul. 24, 2001

(51) Int. Cl.[7] ..... A47D 9/02
(52) U.S. Cl. ..... 5/99.1; 5/93.1
(58) Field of Search ..... 5/99.1, 93.1, 97, 5/98.1; 403/329, 239

(56) References Cited

U.S. PATENT DOCUMENTS 5,752,283 A * 5/1998 Arens ..... 5/187
5,956,786 A * 9/1999 Huang ..... 403/329
6,341,394 B1 * 1/2002 Wang ..... 5/105

* cited by examiner

*Primary Examiner*—Heather Shackelford
*Assistant Examiner*—Fredrick Conley

(57) ABSTRACT

A structure of corner members for a playpen includes a plurality of corner members each having a hollow interior L-shaped seat and a hollow interior L-shaped cover to cover the seat. The seat has a vertical sleeve inside a conjunction to be engaged with a vertical post, a plurality of arcuate grooves in the top, a pair of roughly rectangular holes each including a L-shaped slot for pivoting a pair of rails respectively by an axial pin and a retaining slot in the conjunction. The cover has a plurality of arcuate strips on underside engaged with the arcuate grooves of the seat, a pair of vertical rod spacedly formed on underside to block a vertical portion of the L-shaped slots and an insertion plate under the conjunction engaged with the retaining slot of the seat in a snap fitting.

2 Claims, 9 Drawing Sheets

(3 — 3)

(3"— 3")

(3'— 3')

STRUCTURE OF CORNER MEMBERS FOR A PLAYPEN

BACKGROUND OF THE INVENTION

The present invention relates to the playpen and more particularly to the structure of corner member for a playpen which is assembled or disassembled without using a tool.

Typical corner member of a playpen (as shown in FIG. 1) comprises generally a hollow L-shaped corner member 10, a vertical post 11 inserted in a conjunction of the corner member 10 and a pair of rails 12 respectively pivoted the perpendicular upper portions by screws 13 and nuts 14 or rivets so that the rails 12 can be flattened or collapsed.

However, this type of corner member 10 is assembled or disassembled with tools. Therefore, it is inconvenient and the screws 13 may be loosened.

SUMMARY OF THE PRESENT INVENTION

The present invention has a main object to provide a structure of corner member for a playpen which is assembled or disassembled without using a tool and the assembly is stable and will not be loosened.

Accordingly, the structure of corner members for a playpen of the present invention comprises a plurality of corner members each of the corner members has a hollow interior L-shaped seat, a vertical sleeve in the conjunction for engaging with a vertical post, a projection projected upward from the top of the conjunction, a plurality of arcuate grooves spacedly formed in the top of the two arms of the L-shaped seat, a pair of rectangular thru holes spacedly formed in the grooves and a pair of L-shaped slots respectively in the rectangular thru holes each having a transverse portion for pivoting a pair of rails by a pair of retaining pins; a L-shaped cover covering the top of the seat. The cover has a plurality of inwardly arcuate strips made engageable with arcuate grooves of the seat, a vertical rod made engageable with the vertical portion of the L-shaped slot, a hollow interior projection at the conjunction engageable with the projection of the seat and an insertion plate at the conjunction of the seat engageable with the positioning slot of the cover. Therefore, the above discussed elements are assembled or disassembled without using a tool.

The present invention will become more fully understood by reference to the following detailed description thereof when read in conjunction with the attached drawings.

DETAILED DESCRIPTION OF THE PREFERRED EMBODIMENT

Figure 1:
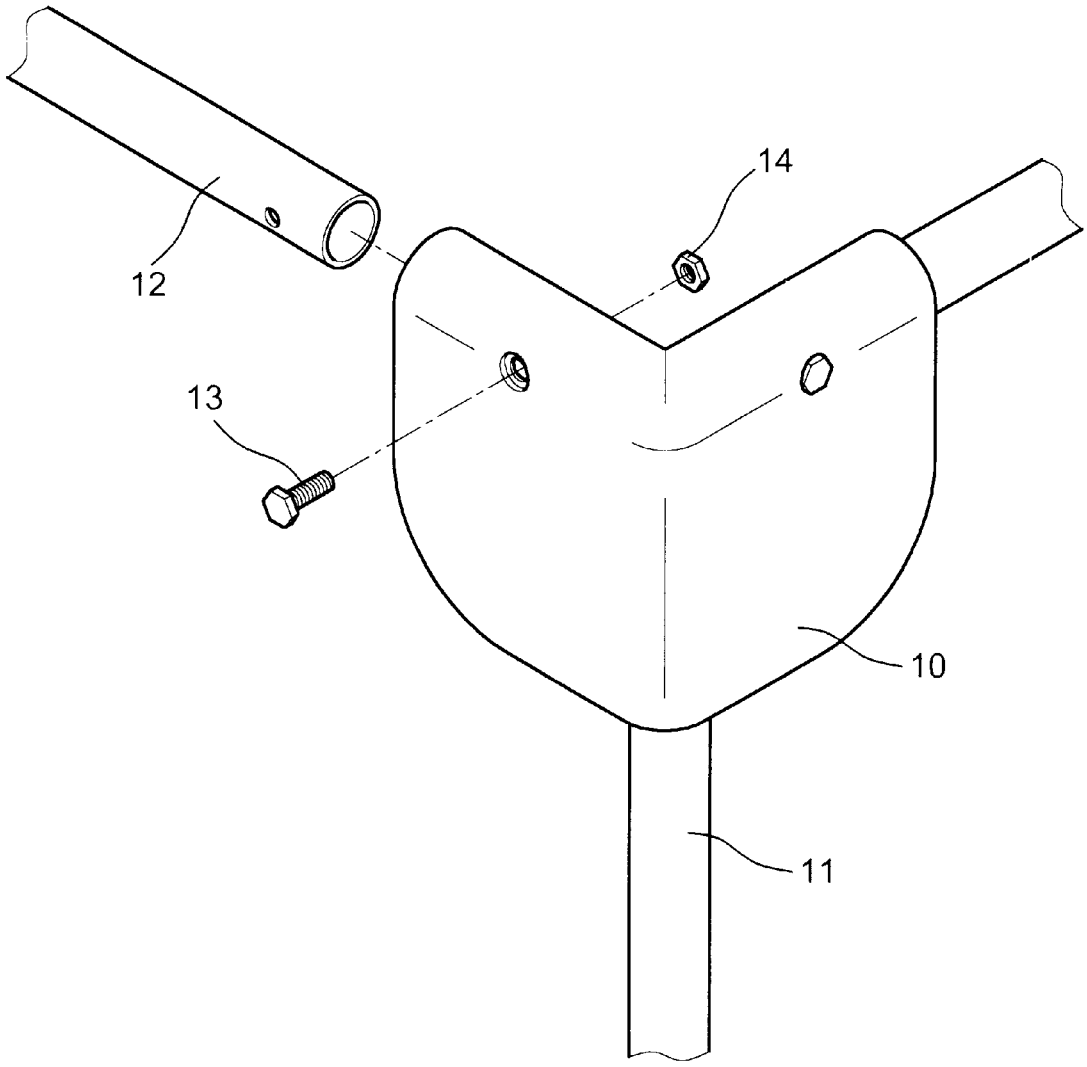
FIG. 1 Prior Art
FIG. 1 is a perspective view of a corner member according to a prior art.
Figure 2:
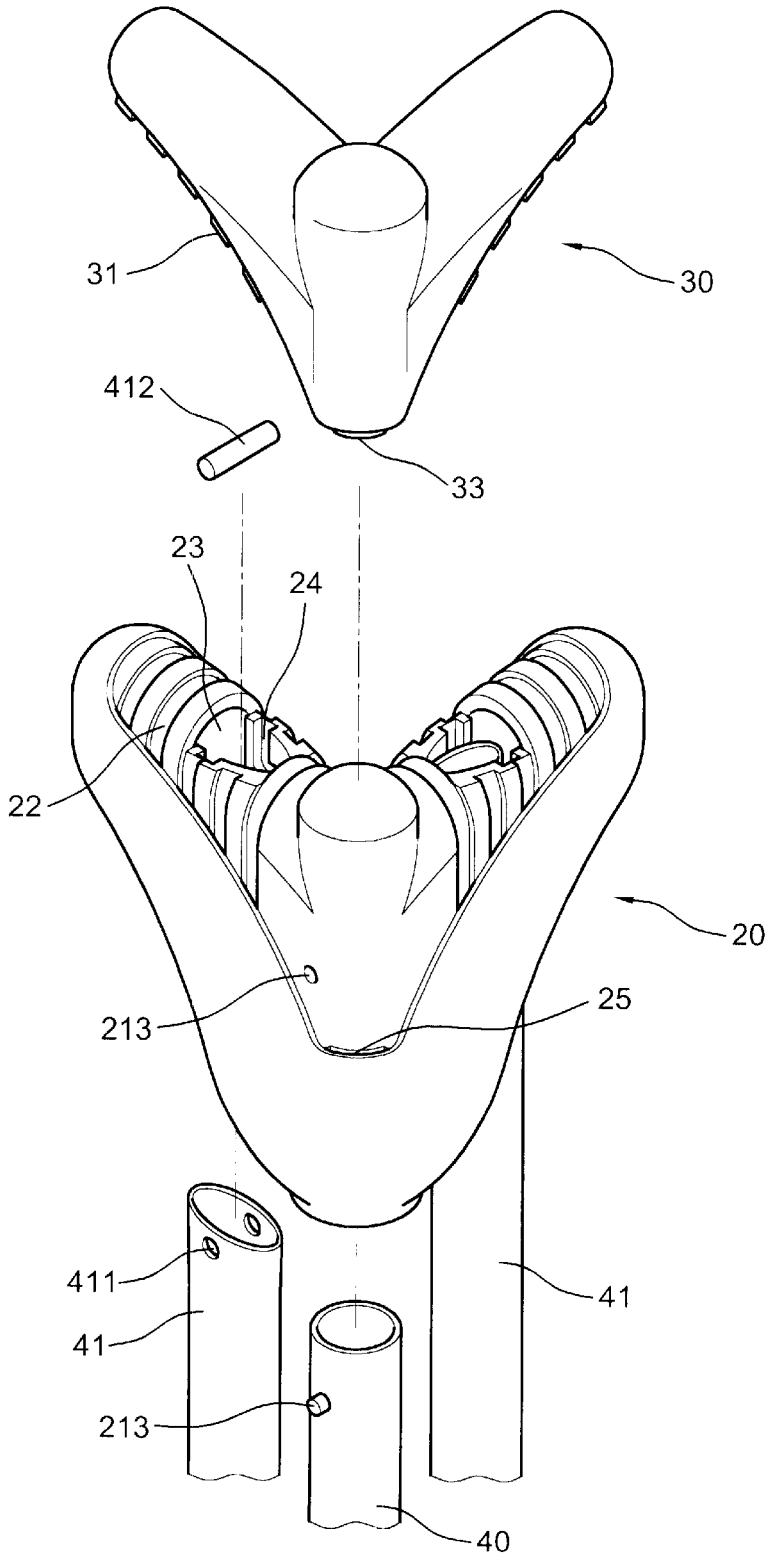
FIG. 2 is an exploded perspective to the corner member of the first preferred embodiment according to the present invention.
Figure 3:
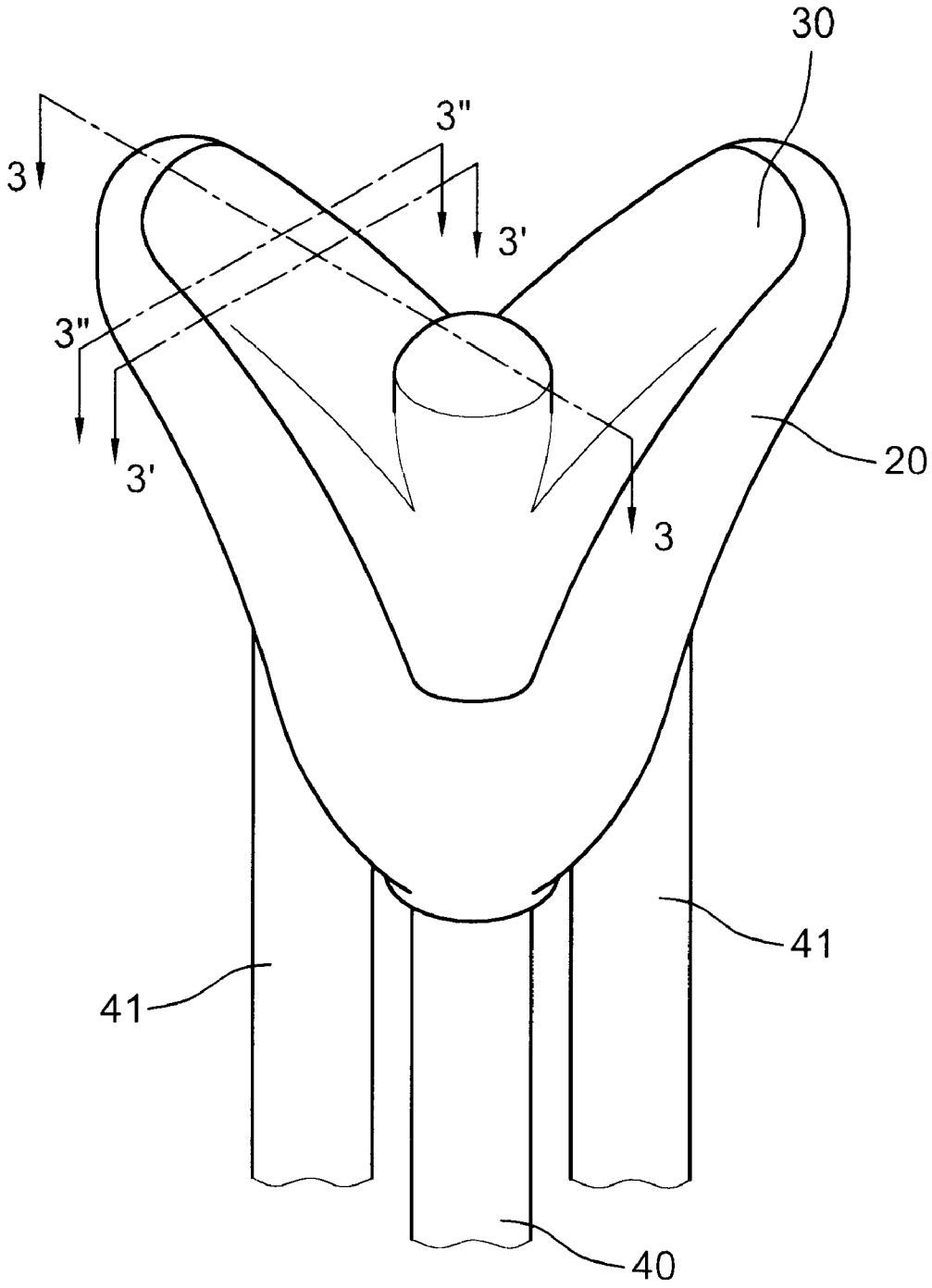
FIG. 3 is a perspective view to show the assembly of the first embodiment of the present invention.
Figure 4:
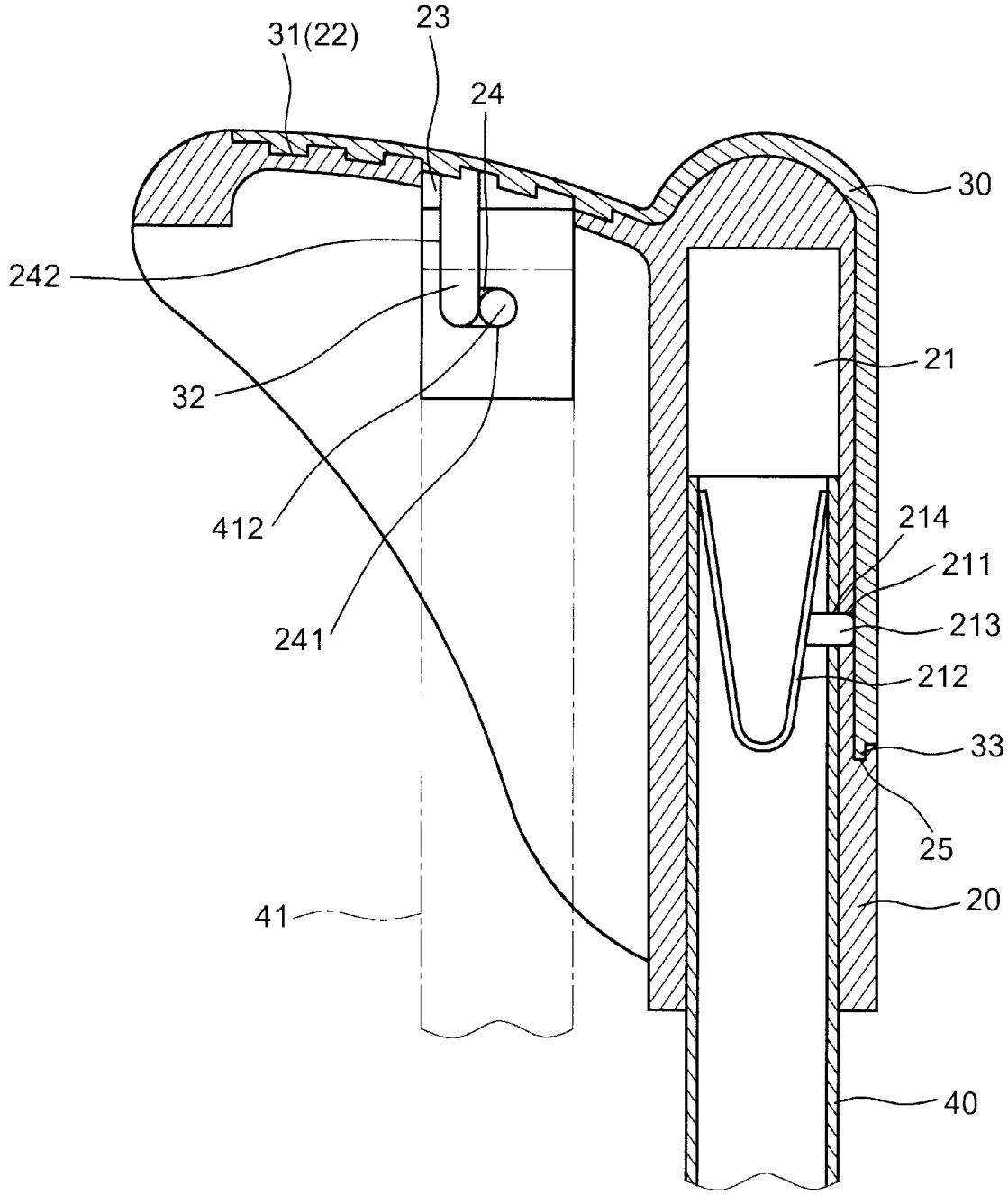
FIG. 4 is a sectional view taken along line 3—3 of FIG. 3.
Figure 6:
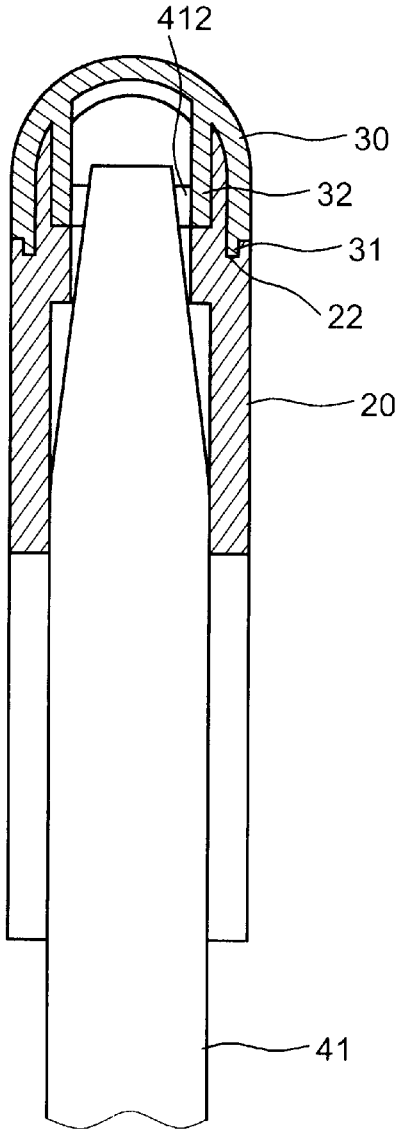
FIG. 6 is a sectional view taken along line 3"—3" of FIG. 3.
Figure 5:
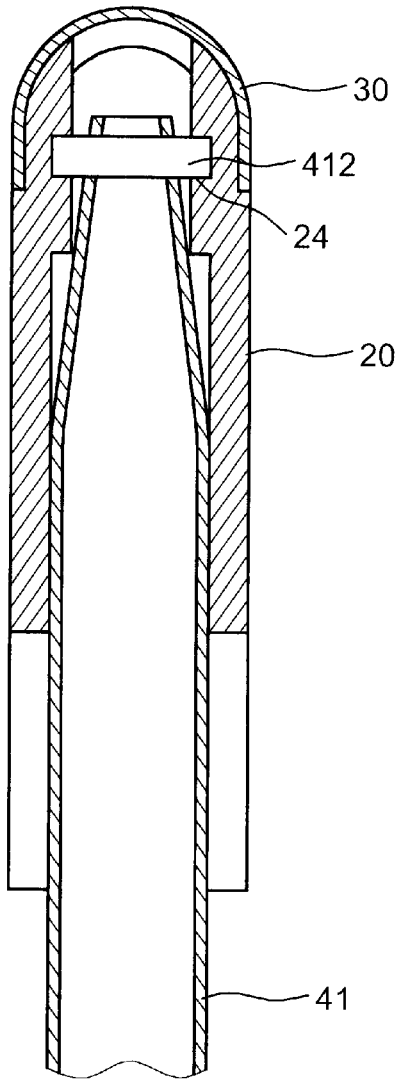
FIG. 5 is a sectional view taken along line 3'—3' of FIG. 3.
Figure 7:
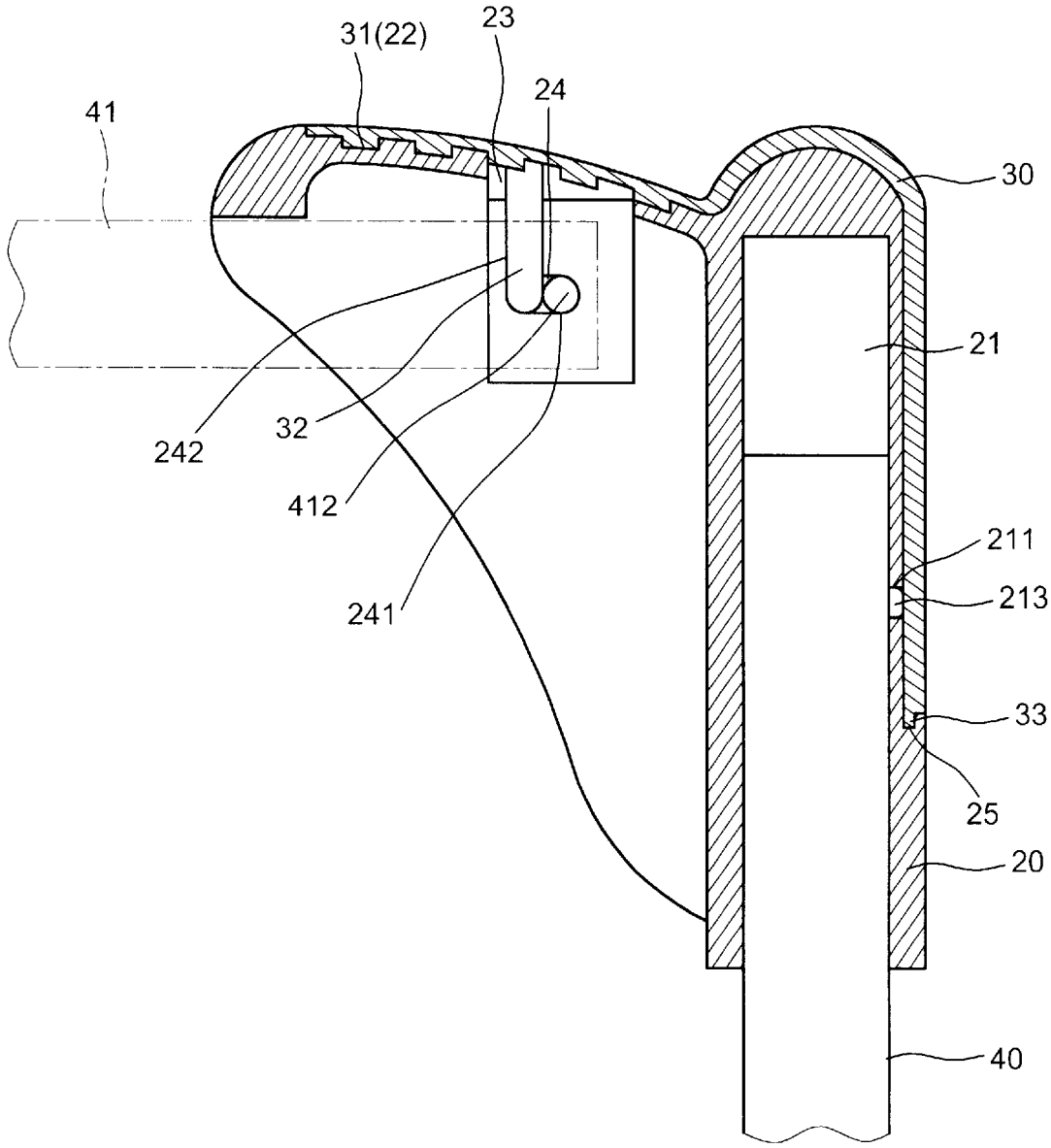
FIG. 7 is a sectional view to show the rail flattened to a horizontal position.

With reference to FIGS. 2, 3 and 4 of the drawings, the corner member of the first preferred embodiment of the present invention comprises generally a plurality of corner members each of which has a hollow interior L-shaped seat 20 and a hollow interior L-shaped cover 30.

Figure 8:
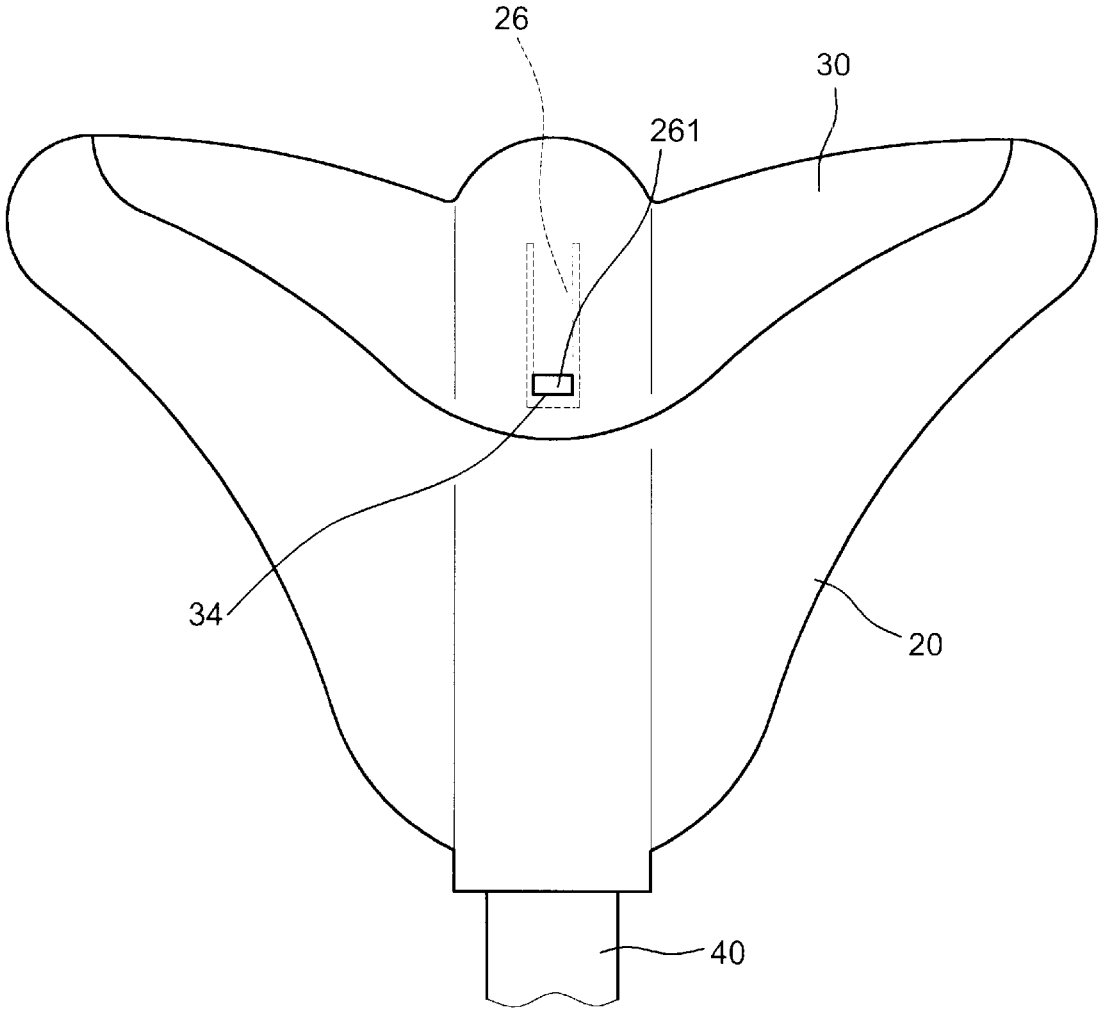
FIG. 8 is a plane view to show an elastic block of the seat inserted into the positioning hole of the cover.
Figure 9:
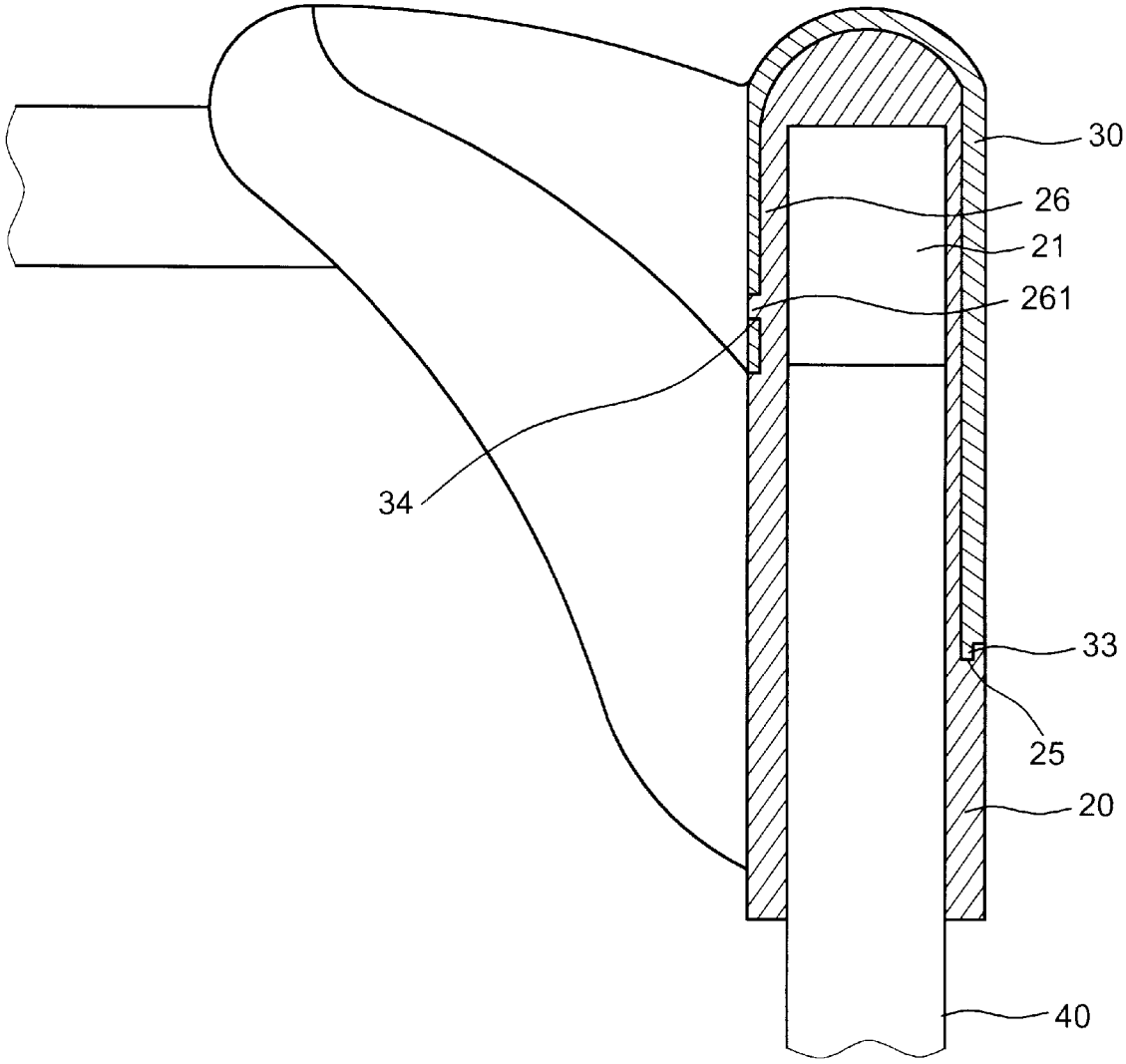
FIG. 9 is a sectional view to show an elastic block of the seat inserted into the positioning hole of the cover.

The seat 20 has a vertical sleeve 21 inside the conjunction including a thru hole 211 in a periphery, a hollow vertical post 40 inserted into the sleeve 21 having a V-shaped spring plate 212 in the top with a bead 213 on one end inserted through the thru hole 214 in a periphery and the thru hole 211 of the sleeve 21, a plurality of arcuate grooves 22 in two arms of the L-shaped on slightly depressed top of the seat 20, a pair of roughly rectangular thru holes 23 spacedly formed in the groove 22 able to receive the top of a pair of rails 41, a pair of L-shaped slots 24 inside the rectangular thru holes respectively each having a transverse portion 241 and a vertical portion 242. The rails 41 each has a aligned thru hole 411 for engaging with an axial pin 412 which engages into the transverse portion 241 (as shown in FIG. 4). A retaining slot 25 in the conjunction of the L-shaped seat 20 and a spring plate 26 inside the conjunction (as shown in FIGS. 8 and 9).

The hollow interior L-shaped cover 30 positions and covers on the top of the seat 20 having a plurality of arcuate strips 31 in two arms engaged with the arcuate grooves 22 of the seat 20, a pair of vertical rods 32 spacedly projected downward from the underside of the two arms engaged with the vertical portion 242 of the L-shaped slots 24 of the seat 20 for preventing the axial pin 412 from rolling into the vertical portion 242, and an insertion plate 33 under the conjunction of the cover 30 to insert into the retaining slot 25 of the seat 20. The spring plate 26 has an elastic block 261 at distal engaged with a positioning hole 34 of the cover 30.

Referring to FIGS. 5 and 6 and 7, 8 again, the assembly of the rails 41, first insert the top of the rails 41 through the rectangular hole 23. When the top of the rails 41 protrudes to the top of the rectangular hole 23, inserts the axial pins 412 through the aligned thru hole 411 of the rails 41, then slides the axial pin 412 through the vertical portion 242 of the L-shaped slot 24 and then positions at the transverse portion 241 of the L-shaped slot 24. The rails 41 can be flattened to their horizontal position or collapsed downward in alignment with the post 40. The assembly of the post 40 is very simply to insert the post 40 into the sleeve 21, the bead 213 will be automatically engaged into the thru hole 211 of the sleeve 21. After the insertion plate 33 and the positioning hole 34 of the cover 30 respectively engaged with the retaining slot 25 and the elastic block 261 of the seat 20, the assembly of all the elements is completed.

When disassembling, press the elastic block 261 inward, the cover 30 will be disengaged with the seat 20. Since the vertical rod 32 no more blocks the L-shaped slot 24, the rail 41 can be able to slide out of the L-shaped slot 24, remove the axial pin 412 from the rail 41 which is free to take off press the bead 213 inward to enable the post 40 to be removed from the vertical sleeve 21 so as to finish the disassembling process.

Accordingly, the assembly or disassembly of the corner members occurs without using any tool and the assembly is very stable and will not be loosened. Further, the seat 20 and the cover 30 may be in different color in order to provide novel sense.

Figure 10:
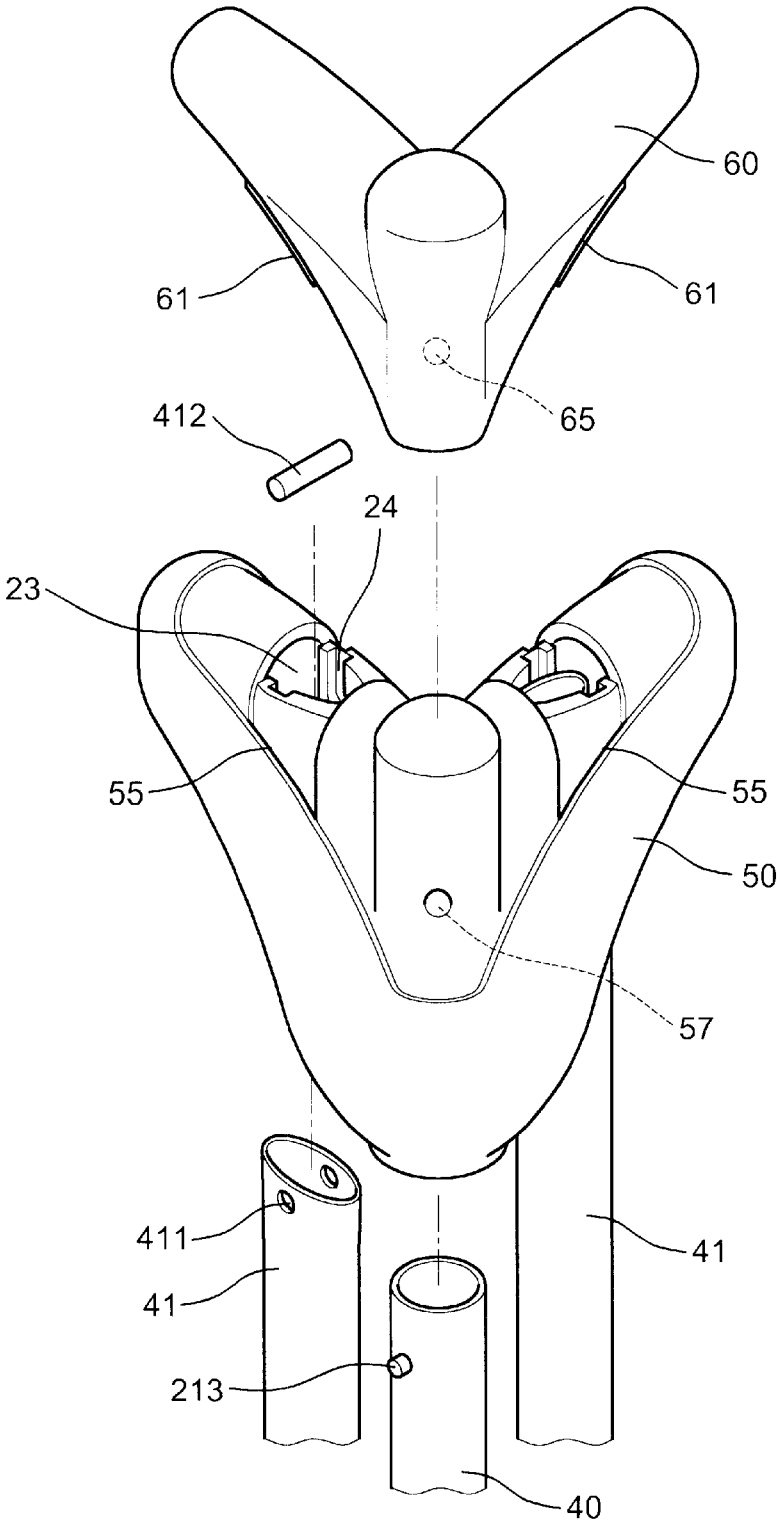
FIG. 10 is an exploded perspective to show a corner member of the second preferred embodiment of the present invention.

Referring to FIG. 10, a second preferred embodiment of the present invention is provided. This embodiment is structurally and functionally most similar to the above embodiment as described in FIGS. 2 to 9 to the above discussions are applicable in the most instances. The only difference is that the seat 50 has no arcuate grooves 22 and retaining slot 25. Instead there is a pair of retaining slots 55 respectively formed in lateral sides and a retaining thru hole 57 in the conjunction. The cover 60 has no arcuate strips 31 and the insertion plate 33. Instead there is a pair of insertion plates 61 respectively formed on lateral sides engageable with the retaining slots 55 of the seat 50 and an inward protrudent rod 65 in a conjunction engageable with the retaining thru hole 57 of the seat 50, and by this change, the assembly of the cover 60 with the seat 50 is also stable without loosening.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A structure of corner members for a playpen comprising:

a plurality of corner members each comprising:

a hollow interior L-shaped seat having a vertical sleeve inside a conjunction of the L-shaped seat including a first thru hole in a periphery, plurality of arcuate grooves respectively formed in two arms of the L-shaped seat slightly depressed relative to the top of the seat, a pair of rectangular thru holes spacedly formed in the grooves respectively, a pair of the L-shaped slots inside the rectangular thru holes each having a transverse portion and a vertical portion, a retaining slot in the conjunction of the L-shaped seat and a spring plate including an elastic block on free end inside the conjunction of the seat;

a hollow vertical post inserted into the vertical sleeve of the L-shaped seat having a V-shaped spring plate with a bead on an end in upper portion of the post, said bead protruded out of a second thru hole in a periphery of the post and engaged with the first thru hole of the vertical sleeve;

a pair of rails respectively and pivotally engaged into the transverse portions of the L-shaped slots each having an aligned thru hole adjacent a top end engaged with an axial pin;

a hollow interior L-shaped cover covering top of the L-shaped seat having a plurality of arcuate strips in two arms engaged with the arcuate grooves of the seat, a pair of vertical rods spacedly projected downward from underside of the two arms engaged with the vertical portions of the L-shaped slots, of the seat respectively, an insertion plate under conjunction of the cover inserted into the retaining slot of the seat in a snap fitting and a positioning hole inside the conjunction thereof engaged with the elastic block of the spring plate of the seat.

2. A structure of cover members for a playpen comprising:

a plurality of cover members each comprising:

a hollow interior L-shaped seat having a vertical sleeve inside a conjunction of the L-shaped seat including a first thru hole in a periphery, a retaining thru hole in form periphery, a pair of rectangular thru holes respectively formed in two arms of the L-shaped seat each having a L-shaped slot therein including a transverse portion and a vertical portion, a pair of retaining slots spacedly formed in middle portion of the arms;

a hollow vertical post inserted into the vertical sleeve of the L-shaped seat having a V-shaped spring plate with a bead on an end in upper portion of the post, said bead protruded out of a second thru hole in a periphery of the post and engaged with the first thru hole of the vertical sleeve;

a pair of rails respectively and pivotally engaged into the transverse portions of the L-shaped slots each having an aligned thru hole adjacent a top end engaged with an axial pin;

a hollow interior L-shaped cover covering the top of the L-shaped seat having a pair of insertion plates under middle portion of the arms of the L-shaped cover engaged into the retaining slots of the L-shaped seat respectively and a protrudent rod in the conjunction of the L-shaped cover engaged with the retaining thru hole of the seat in a snap fitting.

* * * * *